United States Patent [19]

Lyons et al.

[11] Patent Number: 4,803,346

[45] Date of Patent: Feb. 7, 1989

[54] THEFT PROOF CASH DRAWER ASSEMBLY

[75] Inventors: Dale R. Lyons; David C. Wills; George Heys, Jr., all of Cambridge, Ohio

[73] Assignee: NCR Corporation, Dayton, Ohio

[21] Appl. No.: 190,808

[22] Filed: May 6, 1988

[51] Int. Cl.[4] ..... G06C 5/00

[52] U.S. Cl. ..... 235/7 R; 235/1 R; 235/22; 312/333

[58] Field of Search ..... 235/1 R, 2, 5, 6, 7 R, 235/10, 22; 312/211, 212, 250, 293, 308, 333

[56] References Cited

U.S. PATENT DOCUMENTS

| | | | |
|---|---|---|---|
| 2,229,007 | 1/1941 | Showers | 235/22 X |
| 2,628,775 | 2/1953 | Loudon | 235/22 |
| 3,301,479 | 1/1967 | Clary et al. | 235/22 |
| 3,592,521 | 7/1971 | Cox | 312/333 |
| 4,436,989 | 3/1984 | Schuldt | 235/22 |

*Primary Examiner*—B. R. Fuller

*Attorney, Agent, or Firm*—Wilbert Hawk, Jr.; Albert L. Sessler, Jr.; Richard W. Lavin

[57] ABSTRACT

A business machine assembly such as a cash register includes a plurality of hook members secured to the lower surface of the cash register positioned within corresponding slots in a support member. A cash drawer is slidably mounted within the support member between a open and closed position. The cash register further includes a pair of depending stop members secured to the lower surface of the cash register and positioned adjacent the rear edge of the cash drawer when the cash drawer is in a closed position blocking movement of the cash register on the support member thereby preventing the hook members from being disengaged from the slots when the cash drawer is in a closed position.

7 Claims, 3 Drawing Sheets

THEFT PROOF CASH DRAWER ASSEMBLY

BACKGROUND OF THE INVENTION

The present invention is directed to a cash drawer associated with a data terminal device and more particularly to a cash drawer assembly whose construction prevents entry into the cash drawer when in a closed or locked position.

In modern data terminal or electronic cash register devices used in a checkout operation, the opening of the cash drawer prior to the removal of change is automatically controlled by the operation of certain control keys on the keyboard of the terminal device. The operation of these control keys disable the latching mechanism latching the cash drawer in a closed position within the terminal device. When not in use, the cash drawer is normally in a latched or closed position within the terminal device which prevents unauthorized entry into the cash drawer. It has been found that if the terminal device, which is normally mounted on the cash drawer base member, is released from engagement with the base member, the data terminal device can be slidably moved to a position which allows access to the cash drawer to occur.

SUMMARY

There is provided a cash register assembly comprising a data terminal device having a plurality of depending engaging members extending from its lower surface, a support member including a plurality of apertures for receiving said engaging members for slidably supporting said terminal device for movement to a locking position on said support member, a cash drawer member slidably mounted within said support member for movement between an open and closed position, and a plurality of depending stop members secured to the lower surface of the terminal device and located adjacent the rear of the cash drawer member when in a closed position whereby the cash drawer member engages the stop members to block the movement of the terminal device when moved in an unlocking direction on said support member.

It is accordingly an object of the present invention to provide a data terminal device or cash register assembly including a cash drawer which prevents entry to the cash drawer when the cash drawer is in a closed position.

It is a further object of this invention to provide a data terminal device or cash register assembly including a cash drawer which prevents disassembly of the cash register assembly when the cash drawer is in a closed position.

It is another object of this invention to provide a simple and low cost data terminal device or cash register assembly which prevents entry to the cash drawer when the cash drawer is in a closed position.

The above and other objects of the present invention will become more apparent when taken in conjunction with the following description and drawings wherein like characters indicate like parts and which drawings form a part of the present specification.

DESCRIPTION OF THE PREFERRED EMBODIMENT

Figure 1:
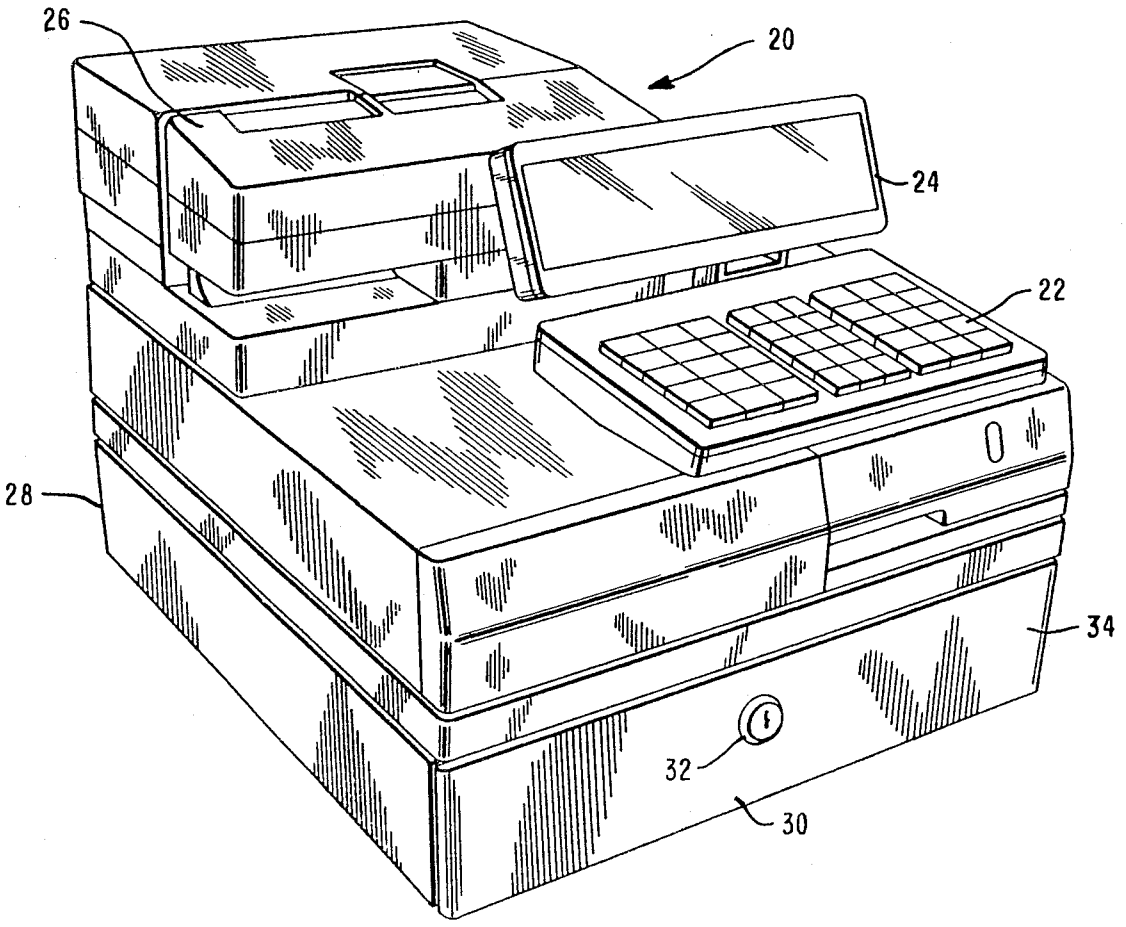
FIG. 1 is a left front perspective view of a data terminal device showing the base member and the cash drawer on which the terminal device is mounted.

Referring now to FIG. 1, there is shown a left front perspective view of a typical data terminal device or cash register generally indicated by the numeral 20 which includes a keyboard 22, a display 24, a printer 26 and a base member 28 on which is slidably mounted a cash drawer 30 used in sales transactions involving the handling of money, particularly checks, bills and coins of different denominations. A key lock assembly 32 mounted in the front wall portion 34 of the cash drawer 30 enables the cash drawer to be locked within the base member 28. As is well known in the art, operation of a control key on the keyboard 22 at the conclusion of the processing of a sales transaction results in the automatic opening of the cash drawer 30.

Figure 2:
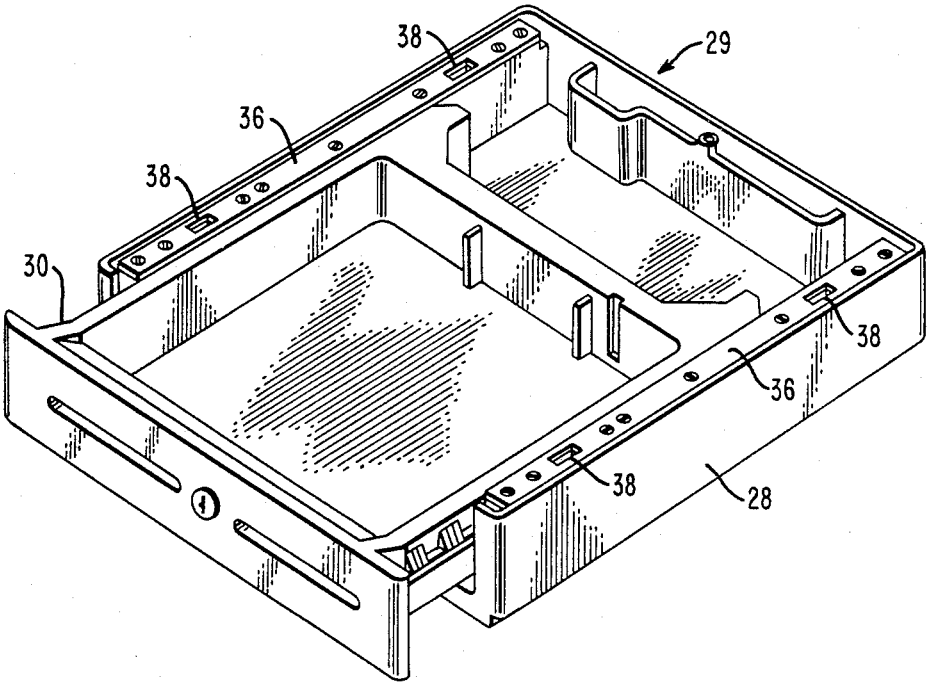
FIG. 2 is a right front exploded perspective view of the cash drawer assembly showing the cash drawer and the base member for slidably supporting the cash drawer.
Figure 3:
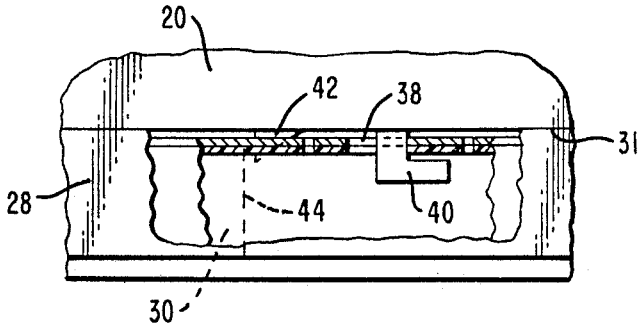
FIG. 3 is a partial side view of the terminal device with portions of the side wall and cash drawer removed showing the location of the stop members with respect to the cash drawer in a closed position and the location of the mounting bracket within the base member.

Referring now to FIG. 2, there is shown a right front exploded perspective view of the base member 28 and the cash drawer 30 which comprise a cash register assembly generally indicated by the numeral 29. The base member 28 includes a pair of side rail portions 36 in which are located slots 38 enabling the terminal device 20 to be mounted on the base member 28. As best shown in FIG. 3, the terminal device 20 has secured to its lower surface 31 a plurality of depending hook members 40, each of which is mounted within one of the slots 38 upon mounting of the terminal device on the base member. The length of each of the slots 38 is greater than the length of the hook members 40, thereby allowing the hook members to drop through the slots 38. The terminal device 20 is then slidably moved towards the rear of the base member 28 locking the terminal device to the base member. The terminal device is further attached to the base member by any type of fastening means such as a screw 48 (FIG. 4).

Mounted to the lower surface 31 of the terminal device intermediate to its sides are a pair of depending stop members 42 (FIG. 3) which are positioned adjacent the rear edge 44 of the cash drawer 30 when the cash drawer is in its closed and locked position. It will be seen from this construction that once the cash drawer is in its closed position, removal of the fastening means attaching the terminal device to the base member will not allow the terminal device to be moved in an unlocking direction towards the front of the base member which normally releases the terminal device from engagement with the base member.

Figure 4:
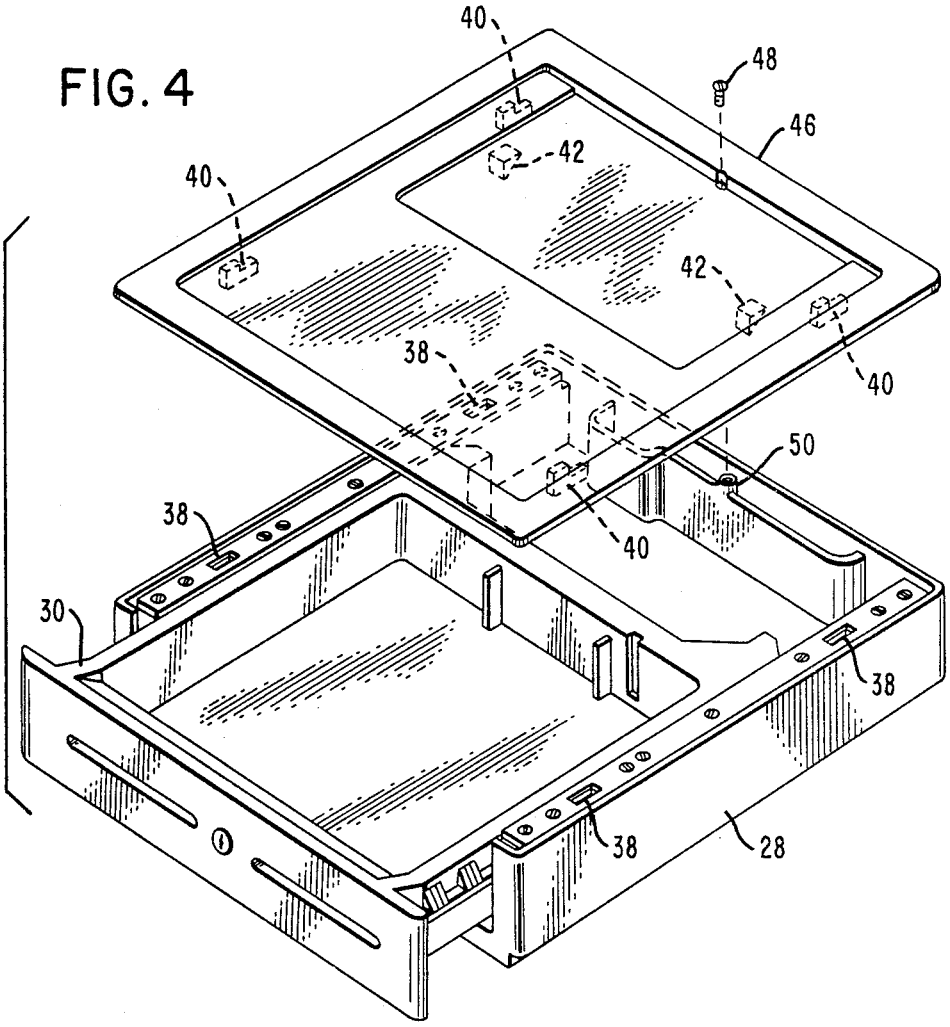
FIG. 4 is an exploded view of a second embodiment of the cash drawer assembly showing the cash drawer and a cover member which normally covers the cash drawer when mounted in the base member, and when the base member is not mounted to the terminal device.

Referring now to FIG. 4, there is shown a second embodiment of the cash drawer assembly 29 in which the present invention is utilized. In some retail establishments, it is required that the cash drawer be located away from the terminal device. In this situation, a cover member 46 is secured to the base member 28 by means of the hook members 40 secured to its lower surface and the screw member 48 which is attached to a rear boss portion 50 of the base member. The cover member 46 includes the depending stop members 42 secured to its lower surface. Removal of the screw member 48 from the boss portion 50 will not allow the cover member 46 to be removed from the base member if the cash drawer 30 is in its closed position in the manner described previously with respect to the terminal device 20. It will thus be seen that the use of the hook members and the stop members prevents entry into the cash drawer when the cash drawer is in its closed position.

While the salient features of the invention have been illustrated and described, it should be readily apparent to those skilled in the art that many changes and modifications can be made in the invention presented without departing from the spirit and true scope of the invention. Accordingly, the present invention should be considered as encompassing all such changes and modifications of the invention that fall within the broad scope of the invention as defined by the appended claims.

What is claimed is:

1. A data terminal device having a plurality of depending engaging members extending from a lower surface thereof;

a support member including a plurality of apertures for receiving said engaging members for slidably supporting said terminal device for movement to a locking position on said support member;

a cash drawer member slidably mounted within said support member for movement between an open and closed position; and a plurality of depending stop members secured to the lower surface of the terminal device and located adjacent a rear of the cash drawer when in a closed position whereby the cash drawer member engages the stop members to block the movement of the terminal device when moved in an unlocking direction on said support member.

2. The data terminal device of claim 1 in which each of said engaging members comprises a hook member slidably positioned within said support member for locking the cash register to the support member.

3. The data terminal device of claim 2 in which said aperture comprises an elongated slot having a length greater than the length of the hook members enabling the hook members to be disposed within the slot prior to movement to a locking position.

4. The data terminal device of claim 3 in which the distance between the cash drawer when in a closed position and the stop members is less than the length of engagement of the hook members within the elongated slots.

5. A business machine assembly comprising:

a business machine member having a plurality of hook members depending from a lower surface thereof;

a support member for supporting said business machine member, said support member having opposite edge portions which include a plurality of elongated slots for receiving a corresponding hook member of said business machine member enabling the hook members to be moved to a locking position within said edge portions;

a cash drawer slidably mounted on said supporting member for movement between an open and closed position within said support member; and a pair of depending stop members secured to the lower surface of the business machine member adjacent a rear of the cash drawer when the cash drawer is in a closed position whereby the stop members will engage the cash drawer upon movement of the business machine member in an unlocking direction on said support member thereby preventing the hook members from being moved to a position unlocking the business machine member from the support member.

6. A cash drawer assembly comprising:

a cover member having a plurality of hook members depending from a lower surface thereof;

a support member for supporting said cover member, said support member having opposite edge portions which include a plurality of elongated slots for receiving corresponding hook members of said cover member enabling the hook members to be moved to a locking position within said edge portions;

a cash drawer slidably mounted on said supporting member for movement between an open and closed position within said support member; and a pair of depending stop members secured to a lower surface of the cover member adjacent a rear of the cash drawer when the cash drawer is in a closed position whereby the stop members will engage the cash drawer upon movement of the cover member in an unlocking direction on said support member thereby preventing the hook members from being moved to a position unlocking the cover member from the support member.

7. A method for mounting a business machine to a cash drawer comprising the steps of:

slidably positioning the cash drawer on a supporting member for movement between an open and closed position;

positioning a plurality of hook members secured to a lower surface of the business machine within corresponding slots located in the support member;

moving the business machine in a first direction on the support member to position the hook members in a locking position within the slots; and positioning a plurality of depending stop members secured to the lower surface of the business machine adjacent a rear edge of the cash drawer when the cash drawer is in a closed position thereby preventing the business machine from being moved in a second direction opposite to said first direction to disengage the hook members from the slots when the cash drawer is in a closed position.

* * * * *